US005256510A

United States Patent [19]

Bugner et al.

[11] Patent Number: 5,256,510

[45] Date of Patent: Oct. 26, 1993

[54] PHOTOELECTROGRAPHIC IMAGING WITH NEAR-INFRARED SENSITIZING DYES

[75] Inventors: Douglas E. Bugner; William Mey, both of Rochester; Dennis R. Kamp, Spencerport, all of N.Y.

[73] Assignee: Eastman Kodak Company, Rochester, N.Y.

[21] Appl. No.: 844,082

[22] Filed: Mar. 2, 1992

Related U.S. Application Data

[63] Continuation-in-part of Ser. No. 632,304, Dec. 21, 1990, abandoned.

[51] Int. Cl.[5] ..... G03G 15/09

[52] U.S. Cl. ..... 430/83; 430/70; 430/96; 430/280

[58] Field of Search ..... 430/83, 70, 280, 96

[56] References Cited

U.S. PATENT DOCUMENTS

| | | | |
|---|---|---|---|
| 3,316,088 | 4/1967 | Schaffert | 96/1 |
| 3,525,612 | 8/1970 | Holstead | 96/1 |
| 3,681,066 | 8/1972 | McGuckin | 96/1 |
| 4,501,808 | 2/1985 | Sakai et al. | 430/59 |
| 4,650,734 | 3/1987 | Molaire et al. | 430/7 |
| 4,661,429 | 4/1987 | Molaire et al. | 430/70 |
| 4,680,244 | 7/1987 | Lehmann et al. | 430/66 |
| 4,681,827 | 7/1987 | Franke et al. | 430/83 |
| 4,708,925 | 11/1987 | Newman | 430/270 |
| 4,882,254 | 11/1989 | Loutfy et al. | 430/59 |

FOREIGN PATENT DOCUMENTS

| | | |
|---|---|---|
| 077258 | 3/1987 | Japan . |
| 097039 | 4/1987 | Japan . |

*Primary Examiner*—Marion E. McCamish
*Assistant Examiner*—S. Rosasco
*Attorney, Agent, or Firm*—Nixon, Hargrave, Devans & Doyle

[57] ABSTRACT

The present invention relates to a photoelectrographic element having a conductive layer in electrical contact with an acid photogenerating layer which is free of photopolymerizable materials and contains an electrically insulating binder and acid photogenerator. A dye which absorbs near-infrared radiation is included in the photoelectrographic element so that the element, when used in electrostatic copying, can be exposed with near-infrared radiation. A method for forming images with this element is also disclosed.

25 Claims, No Drawings

PHOTOELECTROGRAPHIC IMAGING WITH NEAR-INFRARED SENSITIZING DYES

This is a continuation-in-part application of U.S. patent application Ser. No. 632,304 filed Dec. 21, 1990, now abandoned.

FIELD OF THE INVENTION

This invention relates to new photoelectrographic elements and an imaging method of exposing such elements with near-infrared radiation.

BACKGROUND OF THE INVENTION

Acid photogenerators are known for use in photoresist imaging elements. In imaging processes utilizing such elements, the acid photogenerator is coated on a support and imagewise exposed to actinic radiation. The layer containing the acid photogenerator is then contacted with a photopolymerizable or curable composition such as epoxy and epoxy-containing resins. In the exposed areas, the acid photogenerator generates protons which catalyze polymerization or curing of the photopolymerizable composition. Acid photogenerators are disclosed, for example, in U.S. Pat. Nos. 4,081,276, 4,058,401, 4,026,705, 2,807,648, 4,069,055, and 4,529,490.

Acid photogenerators have been employed in photoelectrographic elements to be exposed with actinic or undefined radiation as shown, for example, in U.S. Pat. No. 3,316,088. Photoelectrographic elements have been found useful where multiple copies from a single exposure are desired. See e.g., U.S. Pat. Nos. 4,661,429, 3,681,066 as well as German Democratic Republic Patent No. 226,067 and Japanese Patent No. 105,260. Sensitizer dyes have been disclosed with regard to such elements, but not for sensitization in the near-IR portion of the spectrum. See, for example, in U.S. Pat. No. 3,525,612 and Japanese Patent No. 280,793.

SUMMARY OF THE INVENTION

The present invention relates to a photoelectrographic element comprising a conductive layer in electrical contact with an acid photogenerating layer. The acid photogenerating layer is free of photopolymerizable materials and includes an electrically insulating binder and an acid photogenerator in accordance with U.S. Pat. No. 4,661,429. The present invention constitutes an improvement over U.S. Pat. No. 4,661,429 by incorporating a dye in the photoelectrographic element which absorbs near-infrared radiation. As a result, the element can be sensitized with such radiation.

The present invention also provides a photoelectrographic imaging method which utilizes the above-described photoelectrographic element. This process comprises the steps of: exposing the acid photogenerating layer imagewise to near-infrared radiation without prior charging to create a latent conductivity pattern and printing by a sequence comprising: charging to create an electrostatic latent image, developing the electrostatic latent image with charged toner particles, tranferring the toned image to a suitable receiver, and cleaning any residual, untransferred toner from the photoelectrographic element.

The imaging method and elements of the present invention use acid photogenerators in thin layers coated over a conductive layer to form images. This imaging technique or method takes advantage of the discovery that exposure of the acid generator significantly increases the conductivity in the exposed area of the layer. Imagewise radiation of the acid photogenerator layer creates a persistent differential conductivity between exposed and unexposed areas. This allows for the subsequent use of the element for printing multiple copies from a single exposure with only multiple charging, developing, transferring, and cleaning steps. This is different from electrophotographic imaging techniques where the electrophotographic element must generally be charged electrostatically followed by imagewise exposure for each copy produced. As a result, maximum throughput tends to be limited, and energy consumption is likely to be greater.

The charged toner may have the same sign as the electrographic latent image or the opposite sign. In the former case, a negative image is developed, while a positive image is developed in the latter.

By incorporating a dye which absorbs near-infrared radiation in the photoelectrographic element containing an acid generating layer, such elements are no longer limited to exposure with ultraviolet and visible radiation. Such dyes instead permit exposure with radiation in the near-infrared region of the spectrum (having wavelengths of 650 to 1,000 nm). The use of near-infrared radiation is advantageous, because laser diodes, which emit in this part of the spectrum, are relatively inexpensive and consume little energy. Dyes absorbing near-infrared radiation can be included in the same layer as the acid photogenerating compound or as a separate layer adjacent to the acid photogenerating layer. Certain copper (II) salts, which are known to catalyze the thermal decomposition of iodonium salts especially when used in conjunction with compounds containing secondary hydroxyl groups, may also be included in the acid photogenerating layer.

DETAILED DESCRIPTION OF THE INVENTION

As already noted, the present invention relates to a photoelectrographic element comprising a conductive layer in electrical contact with an acid photogenerating layer which is free of photopolymerizable materials and includes an electrically insulating binder and an acid photogenerator. In this element, the improvement resides in the use of a dye which absorbs near-infrared radiation so that the element can be exposed with such radiation during electrostatic imaging or printing processes.

In preparing acid photogenerating layers, the acid photogenerator, the electrically insulating binder, and the dye are co-dissolved in a suitable solvent, and the resulting solution is coated over the electrically conductive support.

Solvents of choice for preparing acid photogenerator coatings include a number of solvents including aromatic hydrocarbons such as toluene; ketones, such as acetone or 2-butanone; esters, such as ethyl acetate or methyl acetate, chlorinated hydrocarbons such as ethylene dichloride, trichloroethane, and dichloromethane, ethers such as tetrahydrofuran; or mixtures of these solvents.

The acid photogenerating layers are coated on a conducting support in any well-known manner such as by doctor-blade coating, swirling, dip-coating, and the like.

The acid photogenerating materials should be selected to impart relatively little conductivity before irradiation with the conductivity increasing after exposure. Useful results are obtained when the coated layer contains at least about 1 weight percent of the acid photogenerator. The upper limit of acid photogenerator is not critical as long as no deleterious effect on the initial conductivity of the film is encountered. A preferred weight range for the acid photogenerator in the coated and dried composition is from 15 weight percent to about 30 weight percent.

The thicknesses of the acid photogenerator layer can vary widely with dry coating thicknesses ranging from about 0.1 μm to about 50 μm. Coating thicknesses outside these ranges may also be useful.

In general, any compound which generates an acid upon near-infrared radiation exposure may be useful. Although there are many known acid photogenerators useful with ultraviolet and visible radiation, the utility of their exposure with near-infrared radiation is unpredictable. Potentially useful aromatic onium salt acid photogenerators are disclosed in U.S. Pat. Nos. 4,661,429, 4,081,276, 4,529,490, 4,216,288, 4,058,401, 4,069,055, 3,981,897, and 2,807,648 which are hereby incorporated by reference. Such aromatic onium salts include Group Va, Group VIa, and Group VIIa elements. The ability of triarylselenonium salts, aryldiazonium salts, and triarylsulfonium salts to produce protons upon exposure to ultraviolet and visible light is also described in detail in "UV Curing, Science and Technology", Technology Marketing Corporation, Publishing Division, 1978.

A representative portion of useful Group Va onium salts are:

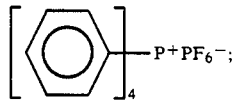

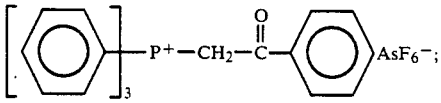

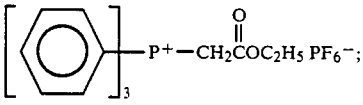

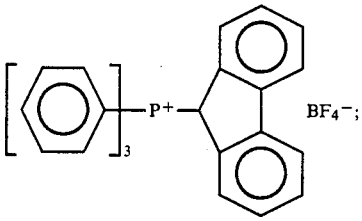

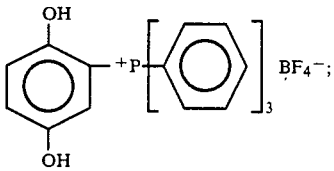

-continued

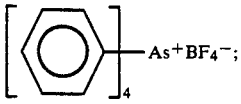

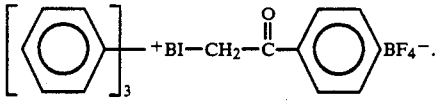

A representative portion of useful Group VIa onium salts, including sulfonium and selenonium salts, are:

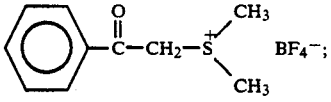

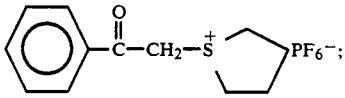

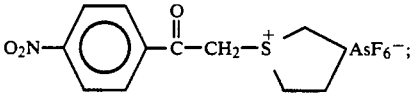

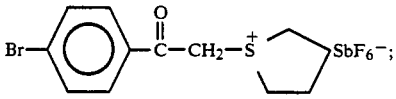

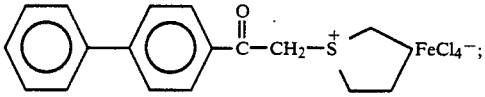

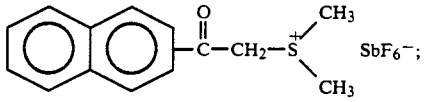

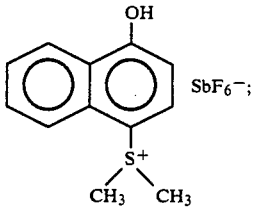

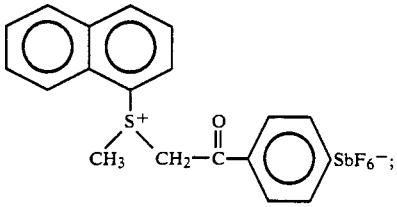

-continued
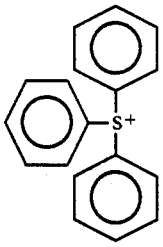
$SbCl_4^-$;
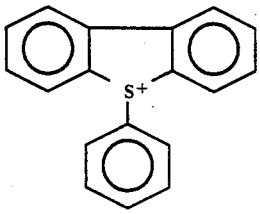
$BF_4^-$;
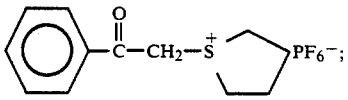
$PF_6^-$;
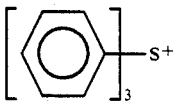
$BF_4^-$;
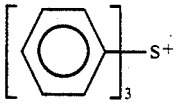
$PF_6^-$;
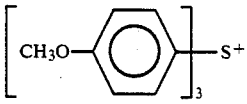
$AsF_6^-$; and
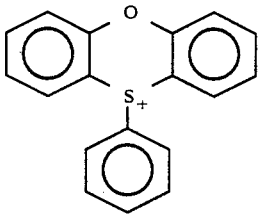
$AsF_6^-$.
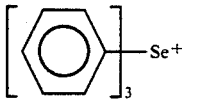
$BF_4^-$;
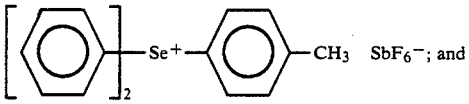
$SbF_6^-$; and
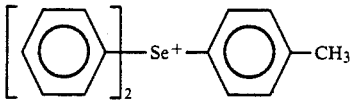
$AsF_6^-$.
A representative portion of the useful Group VIIa onium salts, including iodonium salts, are the following:
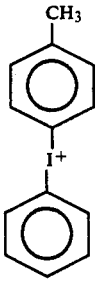
$BF_4^-$;
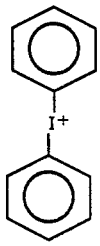
$PF_6^-$;
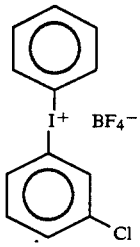
$BF_4^-$;
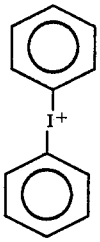
$SbF_6^-$;
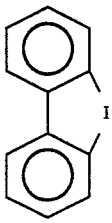
$BF_4^-$;

-continued

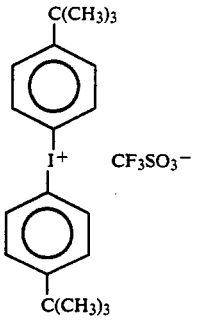

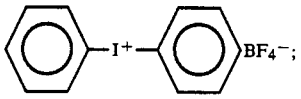

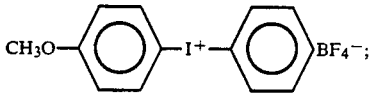

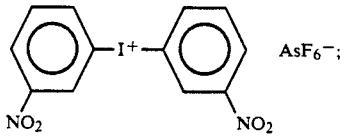

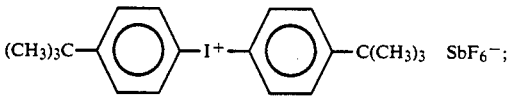

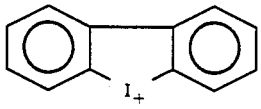

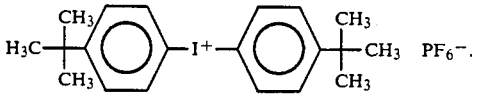

Also useful as acid photogenerating compounds are:

1. Aryldiazonium salts such as disclosed in U.S. Pat. Nos. 3,205,157; 3,711,396; 3,816,281; 3,817,840 and 3,829,369. The following salts are representative:

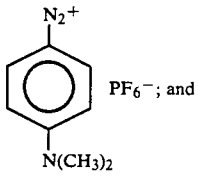

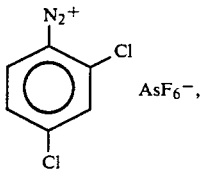

2. 6-Substituted-2,4-bis(trichloromethyl)-5-triazines such as disclosed in British Patent No. 1,388,492. The following compounds are representative:

| | R |
|---|---|
| 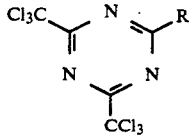 | 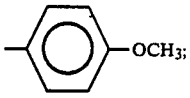 |
| | 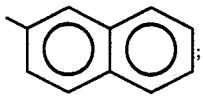 |
| | 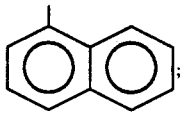 |
| | 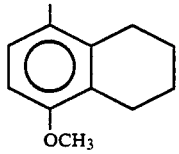 |

A particularly preferred class of acid photogenerators are the diaryliodonium salts, especially di-(4-t-butylphenyl)iodonium trifluoromethanesulfonate ("ITF").

Useful electrically insulating binders for the acid photogenerating layers include polycarbonates, polyesters, polyolefins, phenolic resins, and the like. Desirably, the binders are film forming. Such polymers should be capable of supporting an electric field in excess of $1\times10^5$ V/cm and exhibit a low dark decay of electrical charge.

Preferred binders are styrene-butadiene copolymers; silicone resins; styrene-alkyd resins; soya-alkyd resins; poly(vinyl chloride); poly(vinylidene chloride); vinylidene chloride, acrylonitrile copolymers; poly(vinyl acetate); vinyl acetate, vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc; polystyrene; nitrated polystyrene; poly(vinylphenol)polymethylstyrene; isobutylene polymers; polyesters, such as phenol formaldehyde resins; ketone resins; polyamides; polycarbonates; etc. Methods of making resins of this type have been described in the prior art, for example, styrene-alkyd resins can be prepared according to the method described in U.S. Pat. Nos. 2,361,019 and 2,258,423. Suitable resins of the type contemplated for use in the photoactive layers of this invention are sold under such trade names as Vitel PE 101-X, Cymac, Piccopale 100, Saran F-220. Other types of binders which can be used include such materials as paraffin, mineral waxes, etc. Particularly preferred binders are aromatic esters of polyvinyl alcohol polymers and copolymers, as disclosed in pending U.S. patent application Ser. No. 509,119, entitled "Photoelectrographic Elements".

The binder is present in the element in a concentration of 30 to 98 weight %, preferably 55 to 80 weight %.

Useful conducting layers include any of the electrically conducting layers and supports used in electrophotography. These include, for example, paper (at a relative humidity above about 20 percent); aluminum paper laminates; metal foils, such as aluminum foil, zinc foil, etc.; metal plates, such as aluminum, copper, zinc, brass, and galvanized plates; regenerated cellulose and cellulose derivatives; certain polyesters, especially polyesters having a thin electroconductive layer (e.g., cuprous iodide) coated thereon; etc.

While the acid photogenerating layers of the present invention can be affixed, if desired, directly to a conducting substrate or support, it may be desirable to use one or more intermediate subbing layers between the conducting layer or substrate and the acid photogenerating layer to improve adhesion to the conducting substrate and/or to act as an electrical and/or chemical barrier between the acid photogenerating layer and the conducting layer or substrate.

Such subbing layers, if used, typically have a dry thickness in the range of about 0.1 to about 5 μm. Useful subbing layer materials include film-forming polymers such as cellulose nitrate, polyesters, copolymers or poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Other useful subbing materials include the so-called tergels which are described in Nadeau et al., U.S. Pat. No. 3,501,301.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art and accordingly an extended discussion thereof is unnecessary. Several such overcoats are described, for example, in *Research Disclosure*, "Electrophotographic Elements, Materials, and Processes", Vol. 109, page 63, Paragraph V, May, 1973, which is incorporated herein by reference.

The dye which absorbs near-infrared radiation must not adversely interfere with the operation of the acid photogenerating layer.

One suitable class of dyes has the following formula:

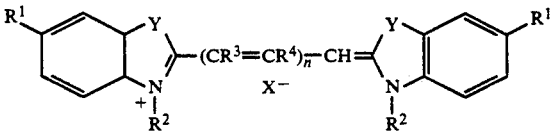

Where: $R^1$=—H, —$NO_2$, alkyl, aryl, —$SO_2R^5$, halo, —$OR^5$, $$-\overset{O}{\overset{\|}{C}}R^5,\ -O\overset{O}{\overset{\|}{C}}R^5,\ \text{or}\ -\overset{O}{\overset{\|}{C}}OR^5,$$

where: $R^5$=alkyl, aryl, or substituted alkyl or aryl;
$R^2$=—H, -alkyl from 1-12 carbons;
$R^3$, $R^4$=

$$-H,\ -X^-,\ -\overset{O}{\overset{\|}{C}}-R^6,$$

halo, alkyl, or aryl;

$R^3$, $R^4$ may be the same or different or may be linked with 1-3 carbon atoms to form a ring;

where: $R^6$ is alkyl, aryl or substituted alkyl or aryl, or may be a link of 0-3 carbons to form a ring;

Y=—S—, —O—, or —$C(R^7)_2$— where $R^7$ is H or an alkyl group of 1-3 carbons.

X- is an anion n is an integer from 1-3.

Examples of such dyes are the following:

Structure 1

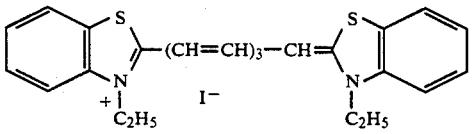

Structure 2

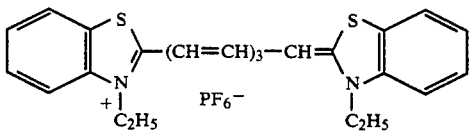

Structure 3

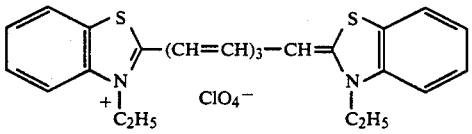

Structure 4

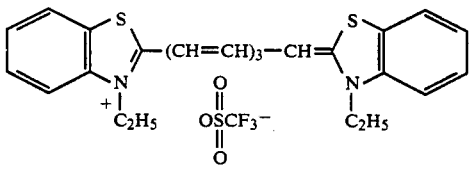

Structure 5

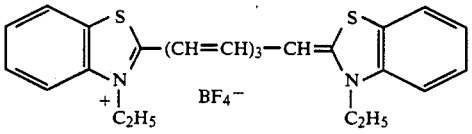

Structure 6

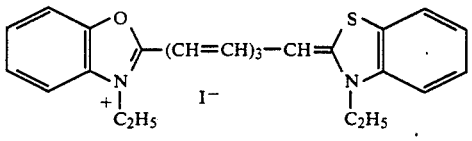

-continued
Structure 7
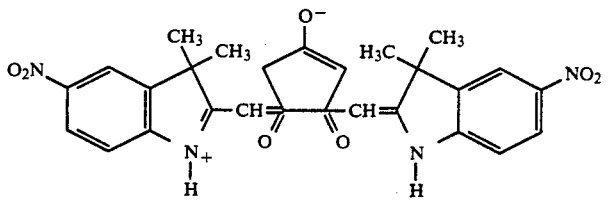
Structure 8
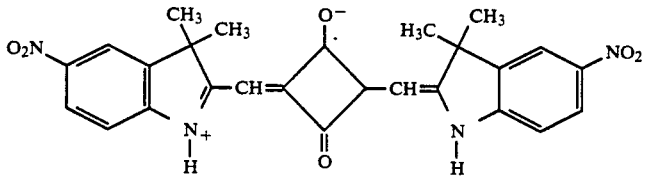
Structure 9
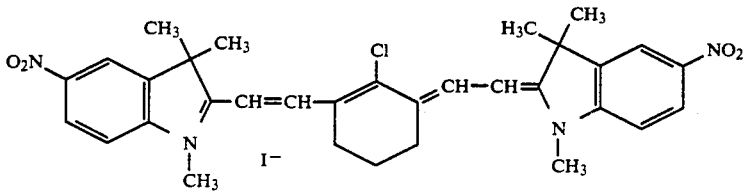
Structure 10
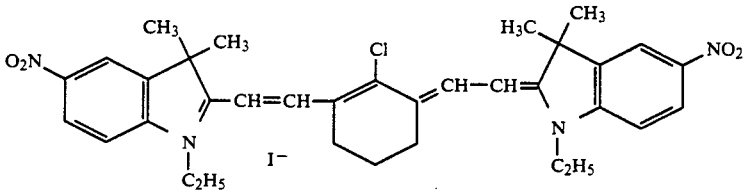
Structure 11
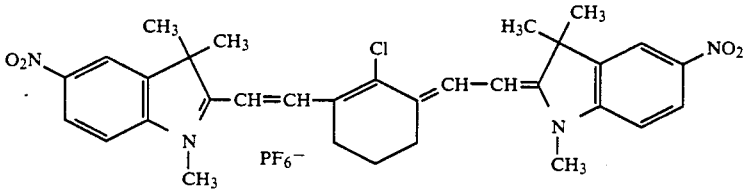
Structure 12
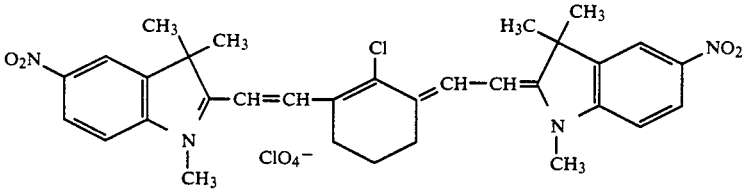
Structure 13
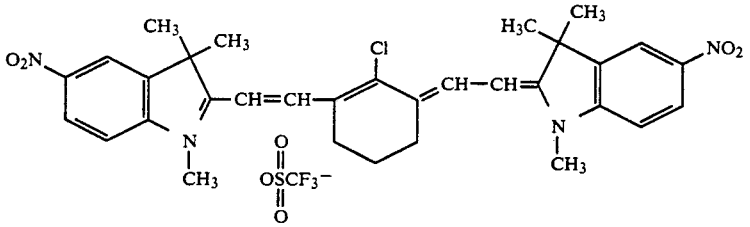
Structure 14
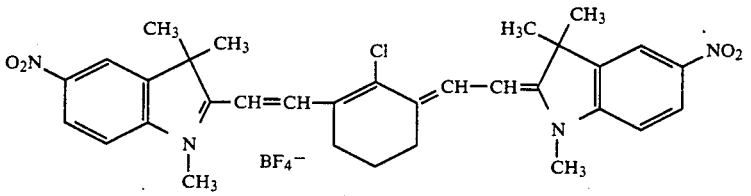

-continued

Structure 15

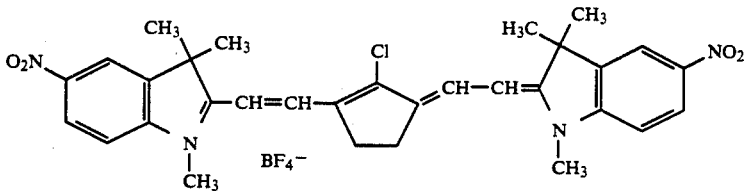

Structure 16

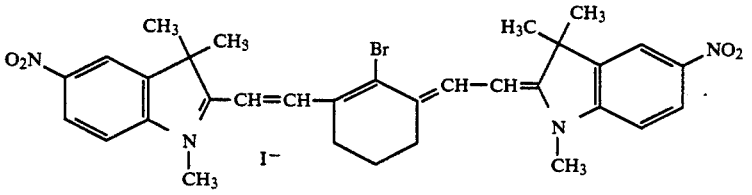

Structure 17

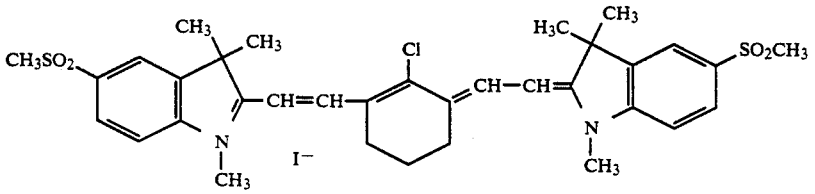

Another suitable class of dyes have the following formula:

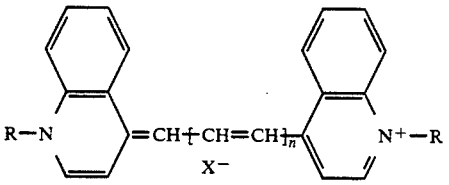

Where

X=an anion,

R=a 1 to 3 carbon alkyl group, and n=1 to 3.

Examples of such dyes are the following:

Structure 18

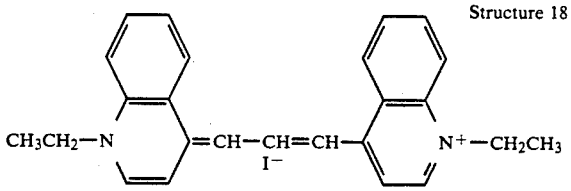

Structure 19

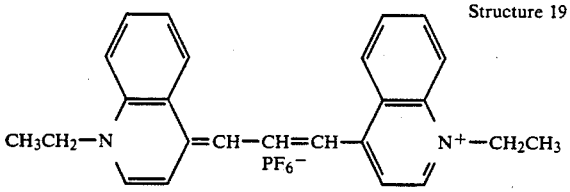

Structure 20

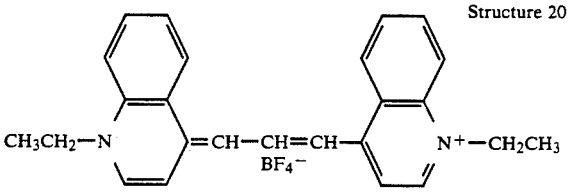

-continued

Structure 21

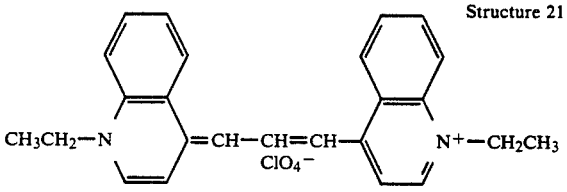

Structure 22

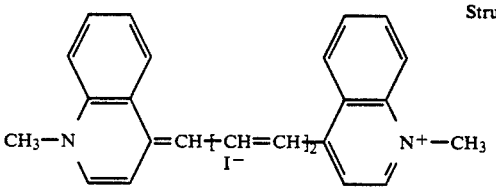

Another suitable class of dyes has the following formula:

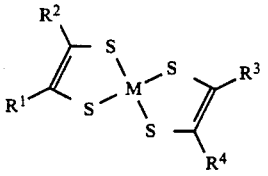

where:

$R^1$–$R^4$ are the same or different and are alkyl,

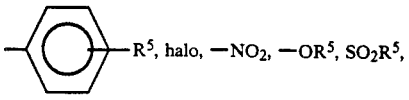

$-R^5$, halo, $-NO_2$, $-OR^5$, $SO_2R^5$, $-\overset{O}{\overset{\|}{C}}-R^5$, $-\overset{O}{\overset{\|}{O}}CR^5$, $-\overset{O}{\overset{\|}{C}}OR^5$, and $-N(R^5)_2$ where $R^5$ is H, -alkyl, -aryl, substituted alkyl or aryl, or $—N(R^6)_2$ where $R^6$ is alkyl from 1-3 carbons.

M is Pt, Pd, or Ni.

Examples of such dyes are the following:

Structure 23

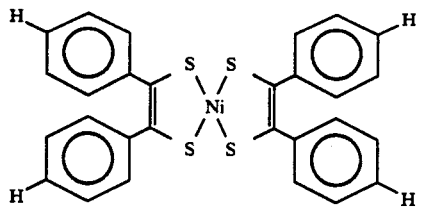

Structure 24

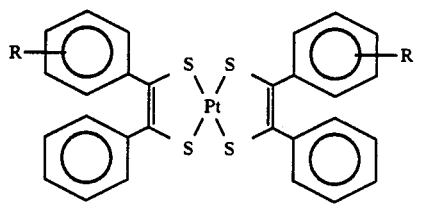

R is a mixture of methyl:iso-propyl:tert-butyl. This compound is a statistical mixture starting from a 1:1:1 mixture of methyl:iso-propyl:tert butyl dithiobenzil Structure 25

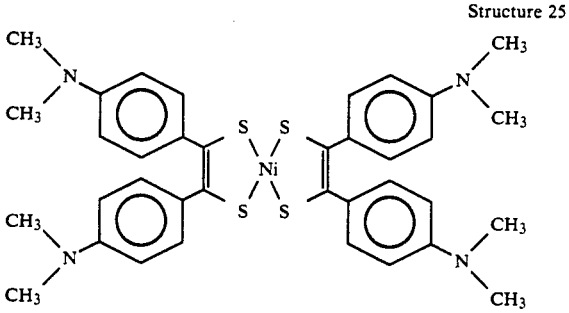

Structure 26

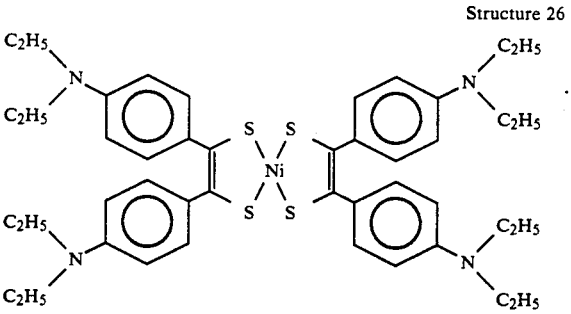

When the acid generating layer contains iodonium salts, it may be advantageous to include in that layer a compound with secondary hydroxyl groups and a copper (II) salt which, when used together, are known to catalyze thermal decomposition of iodonium salts. Suitable copper (II) salts are disclosed by J. V. Crivello, T. P. Lockhart, and J. L. Lee, *J. Polym. Sci., Polym. Chem. Ed.*, 21, 97 (1983). These include copper (II) arylates, copper (II) alkanoates, copper (II) acetonates, copper (II) acetoacetates, and mixtures thereof.

A particularly preferred example of a copper (II) salt useful for this invention is copper (II) ethyl acetoacetate. This salt is soluble in organic solvents such as dichloromethane and can be homogeneously incorporated at concentrations as high as 18% by weight of the dry photoelectrographic element.

The compound with secondary hydroxyl groups include those which contain dialkyl-, diaryl-, alkylaryl-, and hydroxymethane moieties. A particularly preferred compound with secondary hydroxyl groups is the binder polymer having the following formula:

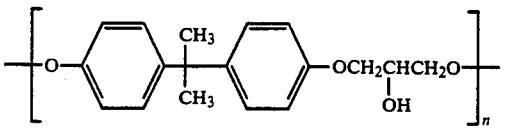

This is a copolymer of bisphenol A and epichlorohydrin, and may be obtained from Aldrich Chemical Company, Milwaukee, Wis. under the trade name PHENOXY RESIN.

The dye can either be included in the acid photogenerating layer or in an adjacent separate layer.

When the dye is incorporated in the acid photogenerating layer, the acid generating layer contains 0.1 to 30, preferably 1-15, weight percent of dye. If a copper (II) salt and a compound with secondary hydroxyl groups are included in this layer, the copper (II) salt is present in an amount of 1 to 20, preferably 10-15, weight percent and, except when PHENOXY RESIN is used, the compound with secondary hydroxyl groups is present in an amount of 1 to 10, preferably 2-4, weight percent. When PHENOXY RESIN is used as the compound with secondary hydroxyl groups, it is also functioning as the binder and then is used in a concentration of 30-98 weight %, preferably 55 to 80 weight %. The thickness of the acid generating layer ranges from 1 to 30 μm, preferably 5 to 10 μm.

If the dye is utilized as a separate layer, that layer is positioned adjacent to the acid photogenerating layer, preferably between the conductive layer and the acid photogenerating layer. The dye containing layer has a thickness of 0.05 to 5, preferably 0.05 to 2.0, μm.

In some cases, it may be optionally desirable to incorporate a near-ultraviolet radiation (250 to 450 nm) sensitizer in the photoelectrographic element. This gives the element the capability of being exposed either with traditional near-ultraviolet radiation or with near-infrared radiation from a laser diode. The amount of near-ultraviolet radiation sensitizer used varies widely, depending upon the type and thickness of the acid photogenerator used as well as the particular sensitizer used. Generally, the near-ultraviolet radiation sensitizer can be present in an amount of up to about 30 percent by weight of the acid generating composition.

Iodonium salt acid photogenerators may be sensitized for near-ultraviolet radiation with ketones such as xanthones, indandiones, indanones, thioxanthones, acetophenones, benzophenones, or other aromatic compounds such as anthracenes, dialkoxyanthracenes, perylenes, phenothiazines, etc. A preferred near-ultraviolet radiation sensitizer is 9,10-diethoxyanthracene.

Triarylsulfonium salt acid photogenerators may be sensitized for near-ultraviolet radiation by aromatic hydrocarbons, anthracenes, perylenes, pyrenes, and phenothiazines.

The photoelectrographic elements of the present invention are employed in the photoelectrographic process summarized above. This process involves a 2-step sequence—i.e. an exposing phase followed by a printing phase.

In the exposing phase, the acid photogenerating layer is exposed imagewise to near-infrared radiation without prior charging to create a latent conductivity pattern. Once the exposing phase is completed, a persistent latent conductivity pattern exists on the element, and no further exposure is needed. The element may then be subjected to the printing phase either immediately or after some period of time has passed.

In the printing phase, the element is given a blanket electrostatic charge, for example, by passing it under a corona discharge device, which uniformly charges the surface of the acid photogenerator layer. The charge is dissipated by the layer in the exposed areas, creating an electrostatic latent image. The electrostatic latent image is developed with charged toner particles, and the toned image is transferred to a suitable receiver (e.g., paper). The toner particles can be fused either to a material (e.g., paper) on which prints are actually made or to an element to create an optical master or a transparency for overhead projection. Any residual, untransferred toner is then cleaned away from the photoelectrographic element.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

By the above-described process, multiple prints from a single exposure can be prepared by subjecting the photoelectrographic element only once to the exposing phase and then subjecting the element to the printing phase once for each print made.

The photoelectrographic layer can be developed with a charged toner having the same polarity as the latent electrostatic image or with a charged toner having a different polarity from the latent electrostatic image. In one case, a positive image is formed. In the other case, a negative image is formed. Alternatively, the photoelectrographic layer can be charged either positively or negatively, and the resulting electrostatic latent images can be developed with a toner of given polarity to yield either a positive or negative appearing image.

The photoelectrographic element of the present invention can be imaged with a laser which emits radiation most efficiently at near-infrared wavelengths. For example, a laser diode with about 200 mW peak power output at 827 nm and a spot size of about 40 μm can be used to image the photoelectrographic element. In a typical device, the element is mounted on a rotating drum, and the laser is stepped across the length of the drum in lines about 25 μm from center to center. The image is written by modulating the output of the laser in an imagewise manner. When photoelectrographic elements of the present invention are imaged in this manner, an imagewise conductivity pattern is formed from which toned images can be produced, as described above.

The invention is further illustrated by the following examples which include preferred embodiments thereof.

EXAMPLES

In the examples which follow, the preparation of representative materials, the formulation of representative film packages, and the characterization of these films are described. These examples are provided to illustrate the usefulness of the photoelectrographic element of the present invention and are by no means intended to exclude the use of other elements which fall within the above disclosure.

EXAMPLE 1

A polyester support was coated successively with solutions of (i) cuprous iodide (3.4 wt %) and poly(vinyl formal) (0.32 wt %) in acetonitrile (96.3 wt %), and (ii) cellulose nitrate (6 wt %) in 2-butanone (94 wt %), such that the layer formed from solution (i) is about 0.5 μm thick, and the layer formed by solution (ii) is about 1.5 μm thick. A formulation consisting of ITF (1.5 wt %), copper (II) ethyl acetoacetate (0.91 wt %), Structure 11 (0.10 wt %), and PHENOXY RESIN (7.49 wt %) in dichloromethane ("DCM") (90 wt %) was completely dissolved and coated over the layer formed from solution (ii) with a 5 mil coating blade under ambient conditions. The resulting photoelectrographic element was dried in a convection oven for 20 min at 60° C. Cross-section and optical microscopy of a sample of this element show it to be approx. 7.4 μm thick. Optical spectroscopy reveals an absorption maximum at 816 nm with an OD of 1.08.

A sample of this film was evaluated for sensitivity to near-IR irradiation in the following manner. The film was exposed on a breadboard equipped with a 200 mW IR laser diode (827 nm output), and the output beam focused to a 40 μm spot. The breadboard consists of a rotating drum, upon which the film is mounted, and a translation stage which moves the laser beam along the drum length. The drum rotation, the laser beam location, and the laser beam intensity are all controlled by an IBM-AT computer. The drum was rotated at a speed of 120 rpm, and the film was exposed to an electronically generated graduated exposure consisting of 11 exposure steps. The line spacing (distance between scan lines in the continuous tone step-wedge) was 25 μm, and the maximum intensity was about 100 mW with an exposure time of about 30 msec/pixel. Within one-half hour after exposure the sample was mounted and tested on a separate linear breadboard. The sample was corona charged with a grid controlled charger set at a grid potential of +500 V. The surface potential was then measured at 1 sec and 15 sec after charging.

The data for this and the other examples are tabulated below in Table 1. The delta V's reported in this table represent the difference in potential between an unexposed area of the film and an area receiving maximum exposure. Several samples were also charged with the charger set at −500 V, and identical results were obtained, thus illustrating the bipolarity of the inventive element.

EXAMPLE 2

An element was prepared in the same manner as that described in Example 1, except that 0.2 wt % of the compound of Structure 11 and 7.39 wt % of PHENOXY RESIN were used. This film was found to be 6.2 μm thick and to exhibit an absorption maximum at 817 nm with OD=2.46. Data for this film, at a drum speed of 120 rpm, is set forth in Table 1.

EXAMPLE 3

An element was prepared in the same manner as that described in Example 1, except that no compound of Structure 11 was added and 7.59 wt % of PHENOXY RESIN was used. This photoelectrographic element was found to be 7.8 μm thick and did not exhibit any absorption at wavelengths greater than 450 nm. Data for this element, at a drum speed of 120 rpm, is listed in Table 1. This element displayed essentially no photoelectrographic activity. It is thus apparent that a near-IR absorbing species must be present in the element.

EXAMPLE 4

An element was prepared in the same manner as that described in Example 1, except that no copper (II) salt was added, and 8.4 wt % PHENOXY RESIN was used. This photoelectrographic element was 9.8 μm thick and exhibited an absorption maximum at 818 nm with OD=3.54. Data for this element, at a drum speed of 120 rpm, is set forth in Table 1.

EXAMPLE 5

This element was coated in the same manner as that described in Example 4, except that 2.5 wt % of ITF and 7.4 wt % of PHENOXY RESIN were used. This element was 9.8 μm thick and had an absorption maximum of 817 nm with OD=3.86. Data for this element, at a drum speed of 120 rpm, is set forth in Table 1.

EXAMPLE 6

A photoelectrographic element was prepared as described in Example 2, except that 2.50 wt % of ITF, 1.52 wt % of the copper (II) salt, and 5.78 wt % of PHENOXY RESIN were used. The top coating was 5.8 μm thick and had an absorption maximum of 816 nm with OD=2.48. Data for this element, at a drum speed of 120 rpm, is set forth in Table 1. This element was also exposed to an electronically-generated continuous-tone image. The photoelectrographic element was subsequently charged and toned, and the toned image was transferred to paper. A good quality image was thus obtained.

EXAMPLE 7

An element was prepared as described in Example 1, except that no compound of the Structure 11, PHENOXY RESIN, or copper (II) salt were added, and the formulation instead contained 3.0 wt % ITF, 1.2 wt % 9,10-diethoxyanthracene, 0.12 wt % of a compound of Structure 1, 7.68 wt % poly(vinylbenzoate-co-vinylacetate), and 88 wt % DCM which were applied as a 10 μm layer. Optical spectroscopy revealed an absorption maximum at 780 nm with an OD of 3.2. Data for this element, at a drum speed of 120 rpm, is set forth in Table 1.

EXAMPLE 8

An element was prepared as described in Example 7, except that the formulation contained 2.7 wt % ITF, 1.5 wt % of the compound of Structure 23, 7.8 wt % poly(-vinylbenzoate-co-vinylacetate), and 88 wt % DCM and was applied as an 11–13 μm layer. Optical spectroscopy revealed an absorption maximum at 870 nm with an OD of 0.4. Data for this element, at a drum speed of 130 rpm, is set forth in Table 1.

EXAMPLE 9

An element was prepared as described in Example 7, except that the formulation contained 3.0 wt % ITF, 0.32 wt % of the compound of Structure 24, 8.68 wt % poly(vinylbenzoate-co-vinylacetate), and 88 wt % DCM which were applied as a 7.0 μm layer. Optical spectroscopy revealed an absorption maximum at 827 nm with an OD of 1.4. Data for this element, at a drum speed of 130 rpm, is set forth in Table 1.

EXAMPLE 10

An element was prepared as described in Example 7, except that the formulation contained 2.5 wt % ITF, 0.18 wt % of the compound of Structure 7, 7.32 wt % poly(vinylbenzoate-co-vinylacetate), and 90 wt % DCM were applied as a 7.0 μm layer. Optical spectroscopy revealed an absorption maximum at 803 nm with an OD of 3.2. Data for this element, at a drum speed of 130 rpm, is set forth in Table 1.

TABLE 1

| EXAMPLE | DELTA V's 1 sec | DELTA V's 15 sec |
|---|---|---|
| 1 | 40 | 100 |
| 2 | 60 | 190 |
| 3 | 30 | 30 |
| 4 | 75 | 160 |
| 5 | 100 | 225 |
| 6 | 150 | 235 |
| 7 | 40 | 165 |
| 8 | 30 | 110 |
| 9 | 35 | 130 |
| 10 | 45 | 160 |

Although the invention has been described in detail for the purpose of illustration, it is understood that such detail is solely for that purpose, and variations can be made therein by those skilled in the art without departing from the spirit and scope of the invention which is defined by the following claims.

We claim:

1. A photoelectrographic element for electrostatic imaging comprising a conductive layer in electrical contact with an acid photogenerating layer which is free of photopolymerizable materials and comprises an electrically insulating binder and an acid photogenerator, wherein the improvement comprises:

a dye in said photoelectrographic element which absorbs near-infrared radiation, thereby making said photoelectrographic element capable of being exposed with near-infrared radiation, said dye selected from the group consisting of compounds having the formula:

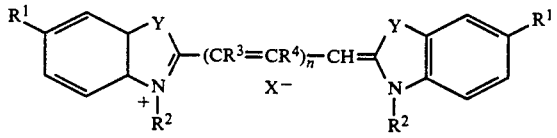

Where:

$R^1$=—H, —$NO_2$, alkyl, aryl, —$SO_2R^5$, halo, —$OR^5$, $-\overset{O}{\overset{\|}{C}}R^5$, $-\overset{O}{\overset{\|}{O}}CR^5$, or $-\overset{O}{\overset{\|}{C}}OR^5$, where: $R^5$=alkyl, aryl, or substituted alkyl or aryl;
$R^2$=—H, -alkyl from 1-12 carbons;
$R^3$, $R^4$=

$$-H,\ -X^-,\ -\overset{O}{\overset{\|}{C}}-R^6,$$

halo, alkyl, or aryl;
$R^3$, $R^4$ may be the same or different or may be linked with 1-3 carbon atoms to form a ring;
where: $R^6$ is alkyl, aryl or substituted alkyl or aryl, or may be a link of 0-3 carbons to form a ring;
Y=—S—, —O—, or —$C(R^1)_2$—
where $R^7$ is H or an alkyl group of 1-3 carbons.
X- is an anion
n is an integer from 1-3;
compounds having the formula:

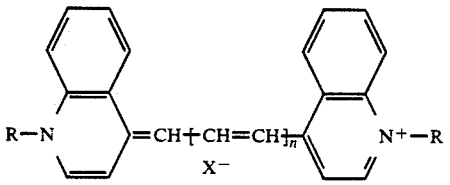

Where
X=an anion,
R=a 1 to 3 carbon alkyl group, and
n=1 to 3; and
compounds having the formula:

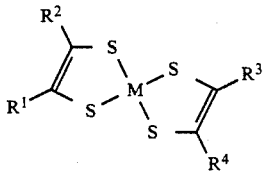

where: $R^1$-$R^4$ are the same or different and are alkyl,

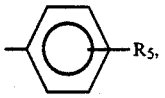

halo, —$NO_2$, —$OR^5$, $SO_2R^5$, $$-\overset{O}{\overset{\|}{C}}-R^5,\ -\overset{O}{\overset{\|}{O}}CR^5,\ -\overset{O}{\overset{\|}{C}}OR^5,\ \text{and}$$

where $R^5$ is H, -alkyl, -aryl, substituted alkyl or aryl, or —$N(R^6)_2$
where $R^6$ is alkyl from 1-3 carbons;
M is Pt, Pd, or Ni; and mixtures thereof.

2. A photoelectrographic element according to claim 1, wherein the acid photogenerator is selected from the group consisting of 6-substituted-2,4-bis(trichloromethyl)-5-triazines, aromatic onium salts containing elements selected from the group consisting of Group Va, Group VIa, and Group VIIa elements, and diazonium salts.

3. A photoelectrographic element according to claim 2, wherein the acid photogenerator is an aromatic onium salt selected from the group consisting of aryl halonium salts, aryl phosphonium salts, aryl arsenonium salts, aryl sulfonium salts, aryl selenonium salts, aryl diazonium salts, and mixtures thereof.

4. A photoelectrographic element according to claim 3, wherein the acid photogenerator is di-(4-t-butylphenyl)iodonium trifluoromethanesulfonate.

5. A photoelectrographic element according to claim 1, wherein the binder is selected from the group consisting of polycarbonates, polyesters, polyolefins, phenolic resins, paraffins, and mineral waxes.

6. A photoelectrographic element according to claim 1, wherein the binder is an aromatic ester of a polyvinyl alcohol polymer.

7. A photoelectrographic element according to claim 1, wherein the acid photogenerating layer contains at least one weight percent of the acid photogenerator.

8. A photoelectrographic element according to claim 1, wherein the dye is in the acid photogenerating layer.

9. A photoelectrographic element according to claim 1, wherein the dye is in a layer separate from the acid photogenerating layer.

10. A photoelectrographic element according to claim 1, wherein the dye is selected from the group consisting of:

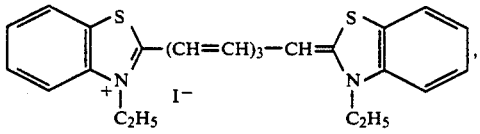

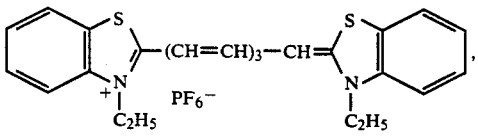

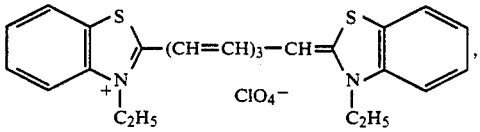

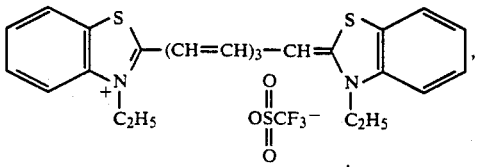

-continued
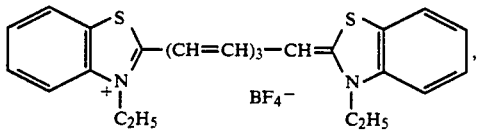
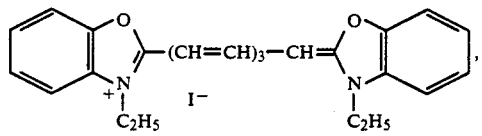
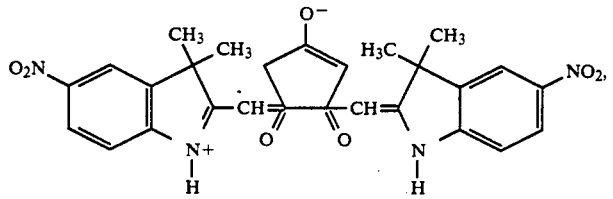
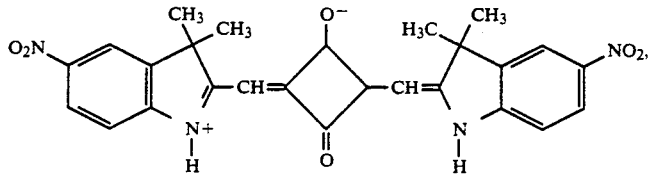
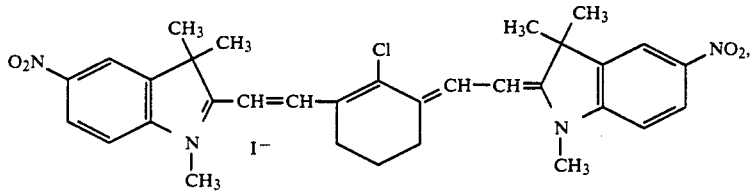
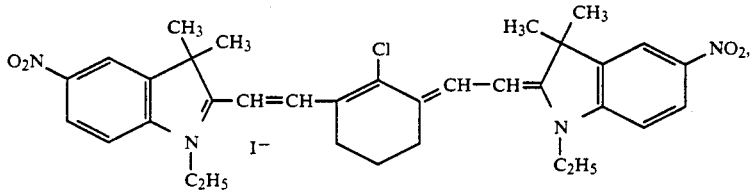
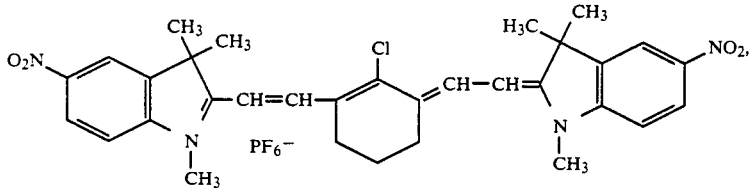
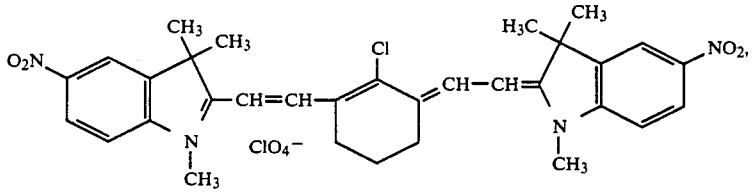
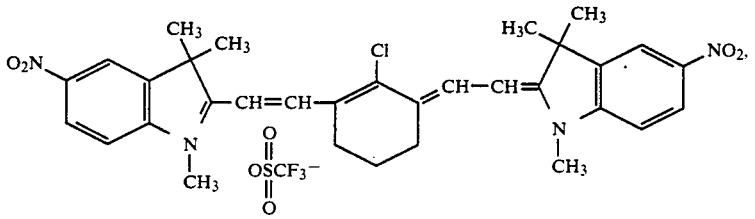

-continued
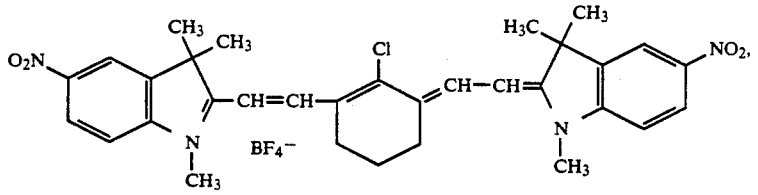
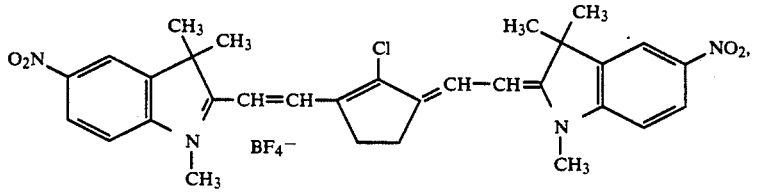
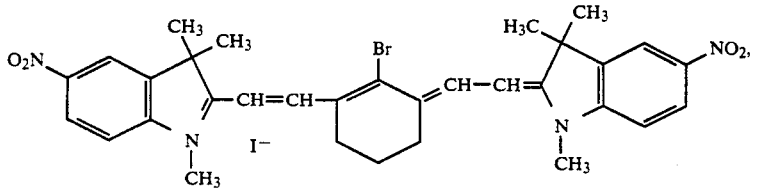
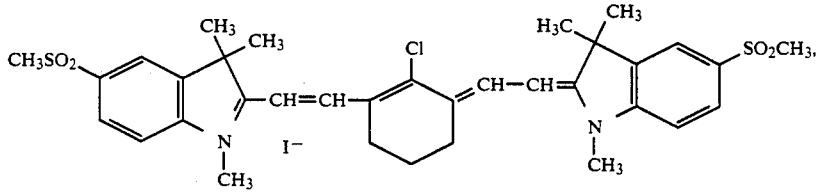
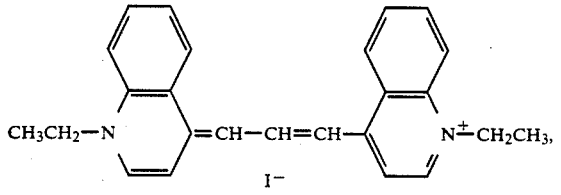
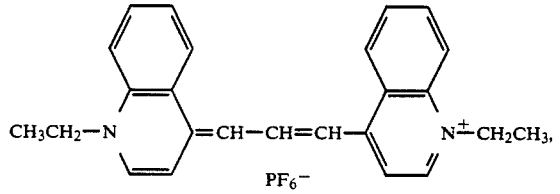
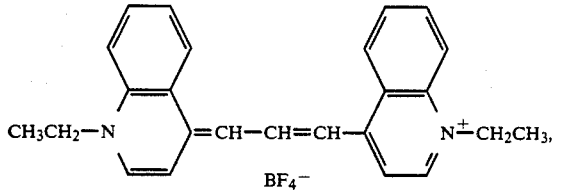
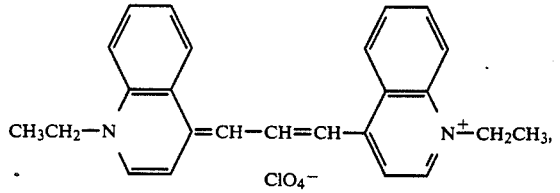
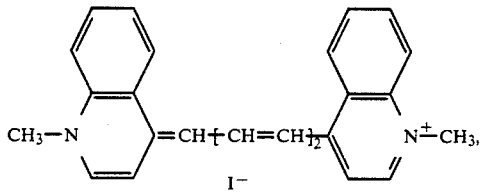
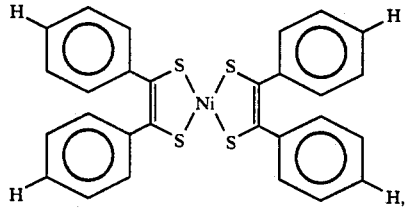

-continued

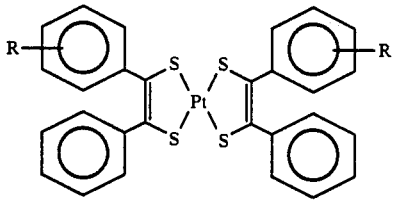

where R is a mixture of methyl:iso-propyl:tert-butyl- this compound is a statistical mixture starting from a 1:1:1 mixture of methyl:iso-propyl:tert butyl dithiobenzil,

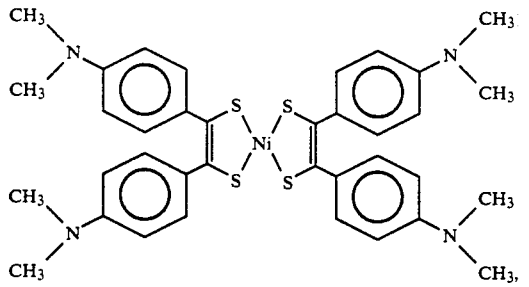

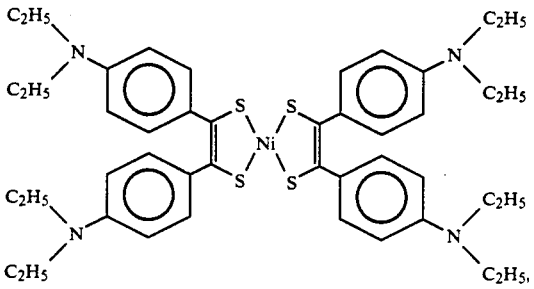

and mixtures thereof.

11. A photoelectrographic element according to claim 10, wherein the dye is selected from the group consisting of:

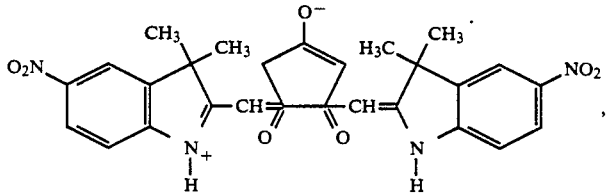

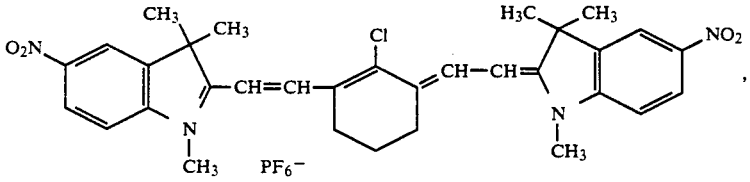

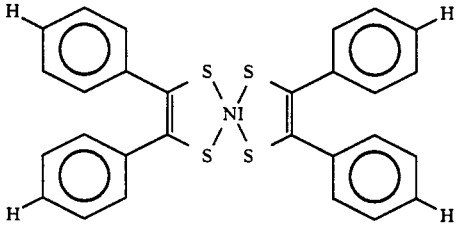

, and

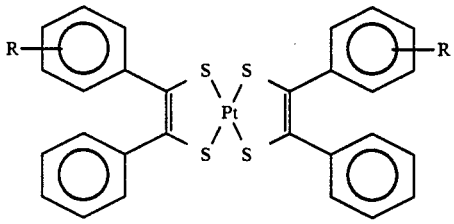

where R is a mixture of methyl:iso-propyl:tert-butyl- this compound is a statistical mixture of methyl:iso-propyl:tert butyl dithiobenzil.

12. A photoelectrographic element according to claim 1, wherein the acid photogenerating layer further comprises:

a copper (II) salt and a compound containing secondary hydroxyl groups.

13. A photoelectrographic element according to claim 12, wherein the copper (II) salt is selected from the group consisting of copper (II) arylates, copper (II) alkanoates, copper (II) acetonates, copper (II) acetoacetates, and mixtures thereof.

14. A photoelectrographic element according to claim 13, wherein the copper (II) salt is copper (II) ethyl acetoacetate and the compound containing secondary hydroxyl groups has the formula:

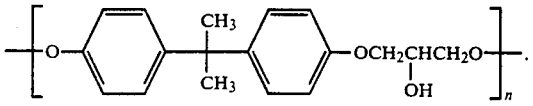

15. A photoelectrographic element according to claim 1 further comprising:

a near-ultraviolet radiation sensitizer.

16. A photoelectrographic method for printing using a photoelectrographic element comprising a conductive layer in electrical contact with an acid photogenerating layer which is free of photopolymerizable materials and comprises an electrically insulating binder, an acid photogenerator, and a dye capable of absorbing near-infrared radiation, said dye selected from the group consisting of compounds having the formula:

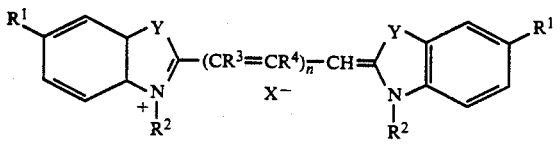

Where: $R^1$=—H, —$NO_2$, alkyl, aryl, —$SO_2R^5$, halo, —$OR^5$,

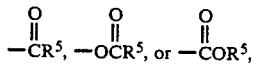

where: $R^5$=alkyl, aryl, or substituted alkyl or aryl;
$R^2$=—H, -alkyl from 1–12 carbons;
$R^3$, $R^4$=

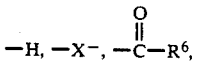

halo, alkyl, or aryl;
$R^3$, $R^4$ may be the same or different or may be linked with 1–3 carbon atoms to form a ring;
where: $R^6$ is alkyl, aryl or substituted alkyl or aryl, or may be a link of 0–3 carbons to form a ring;
Y=—S—, —O—, or —$C(R^7)_2$—
where $R^7$ is H or an alkyl group of 1–3 carbons.
X- is an anion
n is an integer from 1–3;
compounds having the formula;

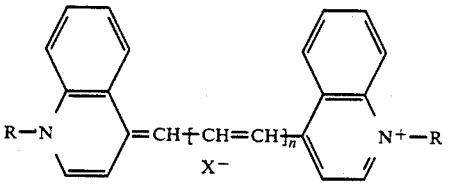

X is an anion,

R=a 1 to 3 carbon alkyl group, and
n=1 to 3; and
compounds having the formula:

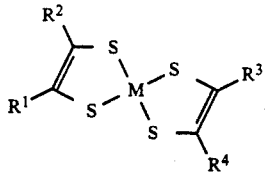

where: $R^1$–$R^4$ are the same or different and are alkyl, halo, —$NO_2$, —$OR^5$, $SO_2R^5$, —$N(R^5)_2$
where $R^5$ is H, -alkyl, -aryl, substituted alkyl or aryl, or —$N(R^6)_2$
where $R^6$ is alkyl from 1–3 carbons.
M is Pt, Pd, or Ni; and mixtures thereof, said method comprising:
exposing the acid photogenerating layer imagewise to near infrared radiation without prior charging to create a permanent latent conductivity pattern and
printing an image from the latent conductivity pattern, said printing comprising:
charging said element with the acid photogenerating layer having a latent conductivity pattern to create an electrostatic latent image;
developing the electrostatic latent image by applying charged toner particles to said element to produce a toned image; and
transferring the toned image to a suitable receiver, wherein said printing is carried out one time for each print made.

17. A method according to claim 16, wherein the acid photogenerator is selected from the group consisting of 6-substituted-2,4-bis(trichloromethyl)-5-triazines, aromatic onium salts containing elements selected from the group consisting of Group Va, Group VIa, and Group VIIa elements, and diazonium salts.

18. A method according to claim 16, wherein the acid photogenerator is an aromatic onium salt selected from the group consisting of aryl halonium salts, aryl phosphonium salts, aryl arsenonium salts, aryl sulfonium salts, aryl selenonium salts, aryl diazonium salts, and mixtures thereof.

19. A method according to claim 18, wherein the acid photogenerator is di(4-t-butylphenyl)iodonium triflurometh anesulfonate.

20. A method according to claim 16, where the dye is selected from the group consisting of

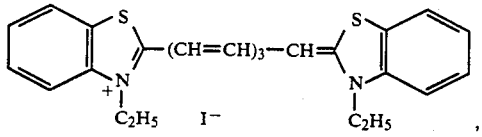

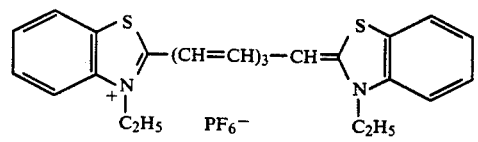

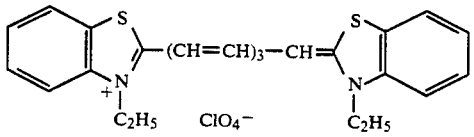

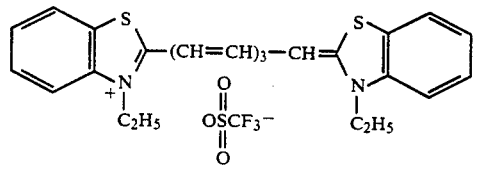

-continued
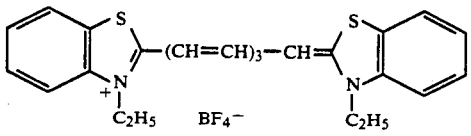
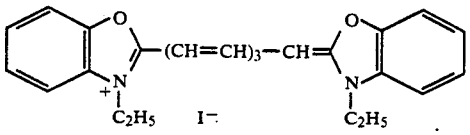
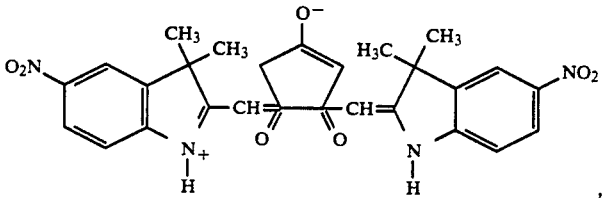
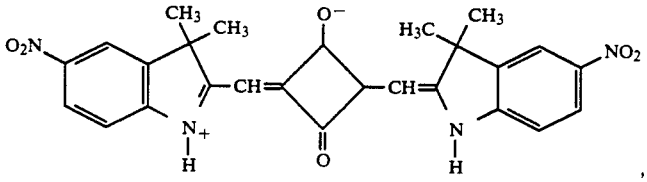
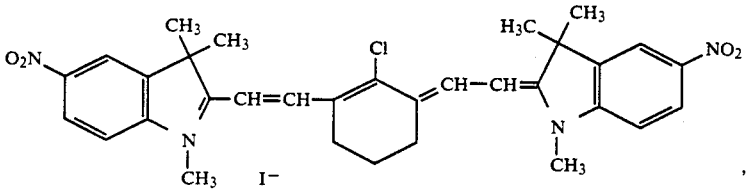
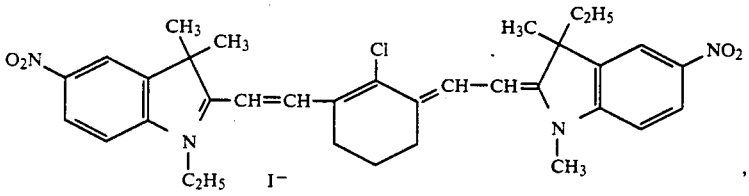
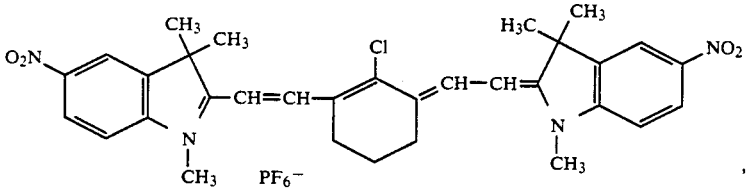
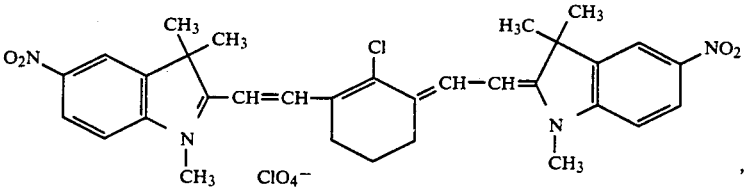
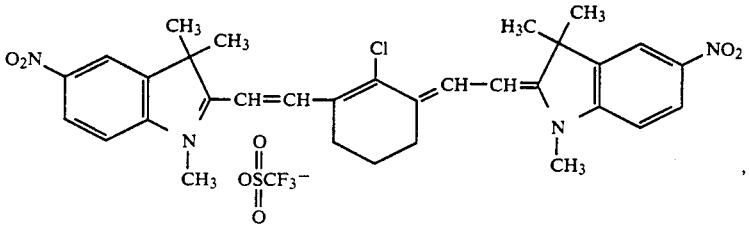

-continued
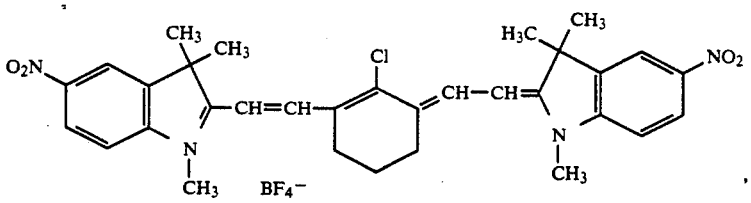
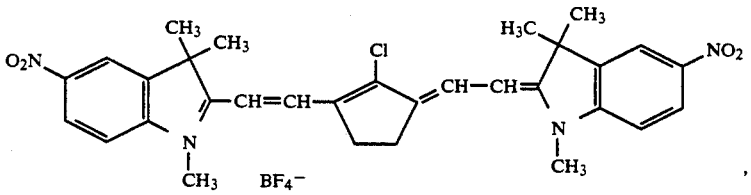
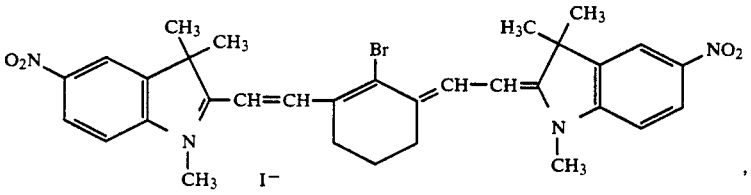
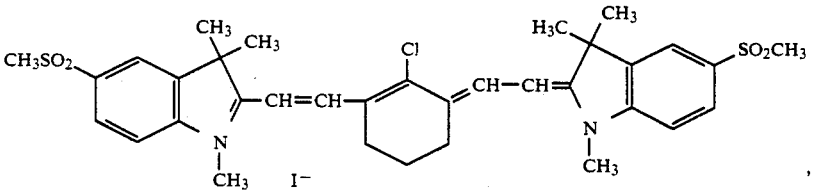
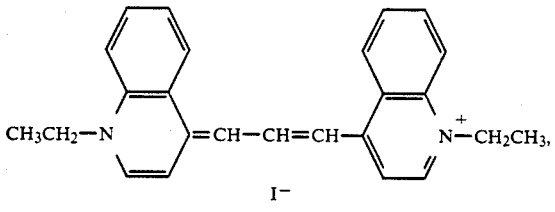
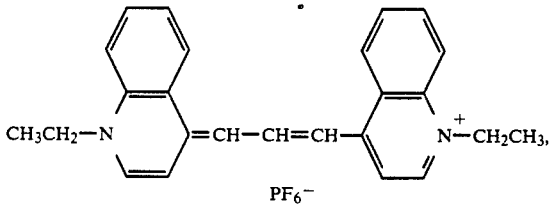
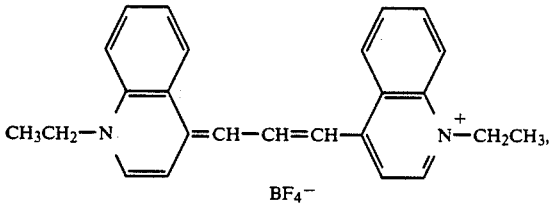
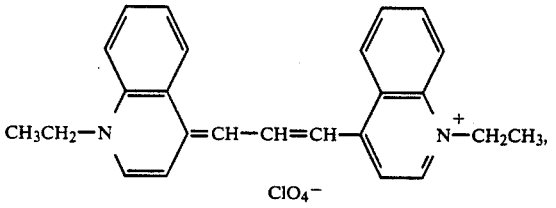
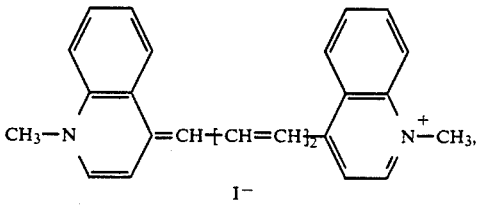

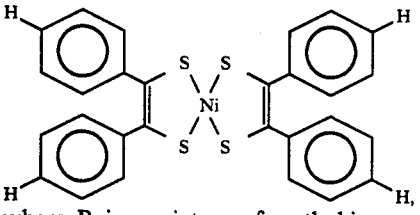

where R is a mixture of methyl:iso-propyl:tert-butyl- this compound is a statistical mixture starting from a 1:1:1 mixture of methyl:iso-propyl:tert butyl dithiobenzil,

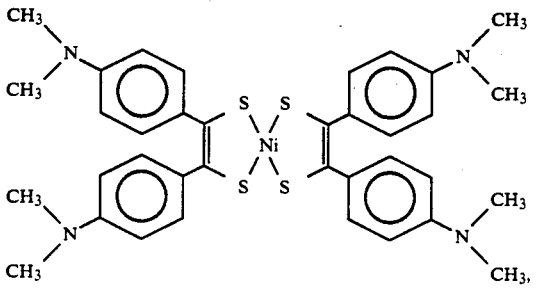

-continued

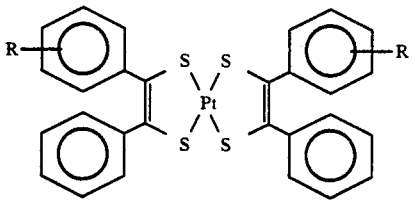

-continued

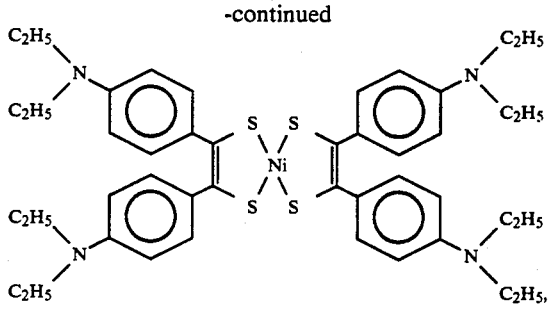

and mixtures thereof.

21. A method according to claim 20, wherein the dye is selected from the group consisting of:

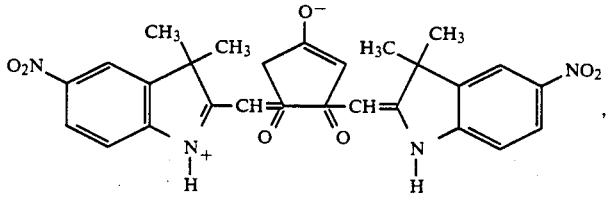

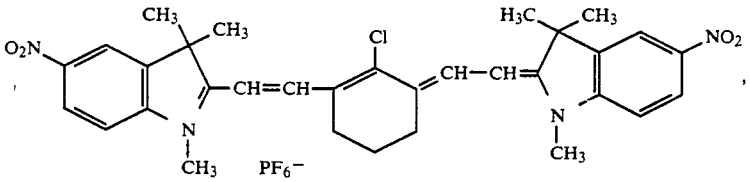

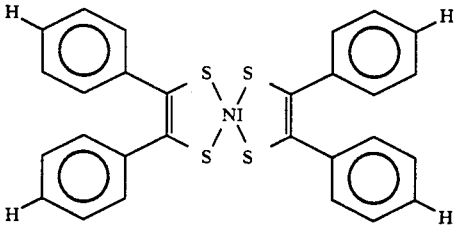

, and

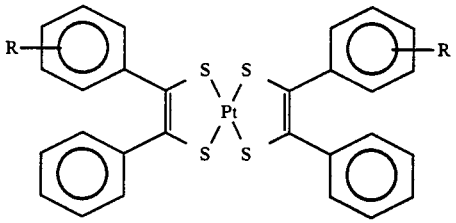

where R is a mixture of methyl:iso-propyl:tert-butyl- this compound is a statistical mixture of methyl:iso-propyl:tert butyl dithiobenzil.

22. A method according to claim 16, wherein the acid photogenerating layer further comprises:

a copper (II) salt and a compound containing secondary hydroxyl groups.

23. A method according to claim 16 further comprising:

cleaning any residual toner particles not transferred to the receiver from the element for each print made.

24. A method according to claim 16, wherein the receiver is a substrate for permanently receiving a toned image as a print.

25. A method according to claim 16, wherein the receiver is a means suitable as an optical master or an overhead transparency.

* * * * *